US006161703A

United States Patent [19]

Mihok

[11] Patent Number: 6,161,703

[45] Date of Patent: Dec. 19, 2000

[54] APPARATUS AND METHOD FOR STORING AND DISPLAYING HATS

[76] Inventor: Thomas Mihok, 2720 Bowman Ave., Bensalem, Pa. 19020-5306

[21] Appl. No.: 09/280,932

[22] Filed: Mar. 29, 1999

[51] Int. Cl.[7] ..... A47F 7/06

[52] U.S. Cl. ..... 211/31

[58] Field of Search ..... 211/30, 31, 113, 211/117; D6/320–328; 248/328

[56] References Cited

U.S. PATENT DOCUMENTS

| | | | |
|---|---|---|---|
| D. 27,923 | 11/1897 | Robbins | 211/113 X |
| 136,587 | 3/1873 | Clarke | 211/31 |
| 217,881 | 7/1879 | Kreis | 211/113 X |
| 365,389 | 6/1887 | Koegel | 211/30 |
| 643,818 | 2/1900 | Headland | 211/113 |
| 1,892,794 | 1/1933 | Wertzler | 211/117 X |
| 2,432,957 | 12/1947 | Webster | 211/113 |
| 2,505,159 | 4/1950 | Teague | 211/113 |
| 2,614,704 | 10/1952 | Winslow | 211/113 X |
| 2,706,632 | 4/1955 | Chandler | 211/113 X |
| 2,962,169 | 11/1960 | Landsman | 211/117 |
| 3,162,473 | 12/1964 | George | 211/113 X |
| 3,188,130 | 6/1965 | Pietrowicz | 224/921 |
| 3,279,428 | 10/1966 | Schad | 211/113 X |
| 3,460,207 | 8/1969 | Stewart | 24/302 |
| 3,833,159 | 9/1974 | Ono | 211/113 X |
| 3,910,417 | 10/1975 | Cook | 211/113 X |
| 4,277,095 | 7/1981 | Barruw | 211/113 X |
| 4,290,531 | 9/1981 | Lazarus, III | 211/113 X |
| 4,441,583 | 4/1984 | Vaught | 211/113 X |
| 4,561,547 | 12/1985 | Estwanik, III | 211/113 |
| 4,903,846 | 2/1990 | Smith | 211/113 |
| 5,052,648 | 10/1991 | Landau | 248/235 |
| 5,067,620 | 11/1991 | Norrie | 211/113 |
| 5,240,123 | 8/1993 | Hawk | 211/32 |
| 5,265,737 | 11/1993 | Freeby | 211/30 |
| 5,295,588 | 3/1994 | Neirinckx | 211/30 |
| 5,351,346 | 10/1994 | Hodges, Jr. | 211/113 X |
| 5,515,978 | 5/1996 | Moran | 211/30 |
| 5,553,719 | 9/1996 | Campbell | 211/30 |
| 5,683,002 | 11/1997 | Rayside | 211/30 |
| 5,762,206 | 6/1998 | Leichter | 211/32 |

*Primary Examiner*—Daniel P. Stodola
*Assistant Examiner*—Jennifer E. Novosad
*Attorney, Agent, or Firm*—LaMorte & Associates P.C.

[57] ABSTRACT

An apparatus and method for holding and displaying a plurality of hats or other objects, by suspending those objects from flexible cords. The apparatus includes a mounting plate that can be mounted to the ceiling or an elevated point on a wall. A plurality of flexible cords extend from the mounting plate. Each of the flexible cords has a first end that is joined to the mounting plate and a second end that hangs free. An attachment mechanism is coupled to the second end of each of the flexible cords. The attachment mechanism is a clip or hook that is capable of selectively engaging a hat or other object. By attaching hats to each of the flexible cords, the hats hang suspended from the mounting plate in a configuration that is easily viewed, space efficient and not harmful to the hats.

7 Claims, 2 Drawing Sheets

APPARATUS AND METHOD FOR STORING AND DISPLAYING HATS

BACKGROUND OF THE INVENTION

1. Field of the Invention

In general, the present invention relates to display devices for displaying and storing hats when the hats are not being worn. More particularly, the present invention relates to suspended display devices that are used to suspend objects on wires, strings or other flexible cords.

2. Description of the Prior Art

Hats, especially baseball cap style hats, are becoming increasingly popular. As such, it is not uncommon for a person to own several such hats as part of their wardrobe. Baseball cap style hats have semirigid brims that should not be folded or crushed. Accordingly, in order to store such hats without damage, the hats must be neatly stored.

Commonly, an owner of numerous baseball cap style hats will fold each hat neatly and will place the hats on top of one another. In this manner, the hats require a minimum of space and the rims of each of the hats is protected. A problem with such a storage technique is that only the hat at the top of the stack is visible. Accordingly, if a person is looking for one specific hat, the stack must be shuffled until the desired hat is found.

Although the shuffling of hats may seem like a minor inconvenience, the degree of the problem increases with the number of hats being stored. If a person owns many different hats that are stored in numerous different stacks, it can be a rather large inconvenience to find the one hat being sought. Similarly, if a store has an inventory of dozens of different hats, the store does not want its customers shuffling through all the hats in order to find the particular type or size that customer wants.

Recognizing the disadvantages of stacking hats on top of one another, numerous different display devices have been created in the prior art for displaying hats in a more convenient manner. Some of the prior art devices are designed to hold numerous hats on a wall display. As such, these prior art devices are primarily intended to be used in retails stores, where hats are on display for sale. Such prior art devices are exemplified by U.S. Pat. No. 5,240,123 to Hawk, entitled Baseball Cap Holder, and U.S. Pat. No. 5,762,206 to Leichter, entitled Cap Rack.

Yet other prior art designs are intended to hold numerous hats on a clothes rack in a closet. Such prior art devices are exemplified by U.S. Pat. No. 5,265,737 to Freeby, entitled Portable Swivel Visor Cap Rack and U.S. Pat. No. 5,638,002 to Rayside, entitled Cap And Visor Organizer.

Although wall displays for hats and closet displays for hats enable a person to see all of the hats in a collection, such displays do require a significant amount of wall space or closet space to use. Accordingly, such prior art devices are used primarily by stores and are not practical for use in the bedroom of an individual, where both wall space and closet space are limited.

U.S. Pat. No. 5,553,719 to Campbell, entitled Flexible Hat Storage Device, shows a hat storage device that stores hats in a space efficient manner. In the Campbell patent, a mesh bag is shown, wherein the hats are stored randomly in the mesh bag. The mesh bags allow for all the hats to be viewed in a space efficient manner. However, viewing the hats is difficult and the hats can readily become deformed due to lack of support within the bag.

A need therefore exists in the art for a device for displaying a plurality of hats in a space efficient manner, wherein the hats are easily viewed and are well supported. A need also exists for such a device, wherein the device does not require use of wall space or closet space when holding the plurality of hats. These needs are met by the present invention as described and claimed below.

SUMMARY OF THE INVENTION

The present invention is an apparatus for holding and displaying a plurality of hats or other objects, by suspending those objects from flexible cords. The apparatus includes a mounting plate that can be mounted to the ceiling or an elevated point on a wall. A plurality of flexible cords extend from the mounting plate. Each of the flexible cords has a first end that is joined to the mounting plate and a second end that hangs free.

An attachment mechanism is coupled to the second end of each of the flexible cords. The attachment mechanism is a clip or hook that is capable of selectively engaging a hat or other object. By attaching hats to each of the flexible cords, the hats hang suspended from the mounting plate in a configuration that is easily viewed, space efficient and not harmful to the hats.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used to store and display numerous different objects, such as scarfs, ties, T-shirts and the like, the present invention device is especially well suited for use in storing and displaying baseball cap style hats. Consequently, by way of example, the present invention will be described in an application where it is used to support and display a plurality of baseball cap style hats.

Figure 1:
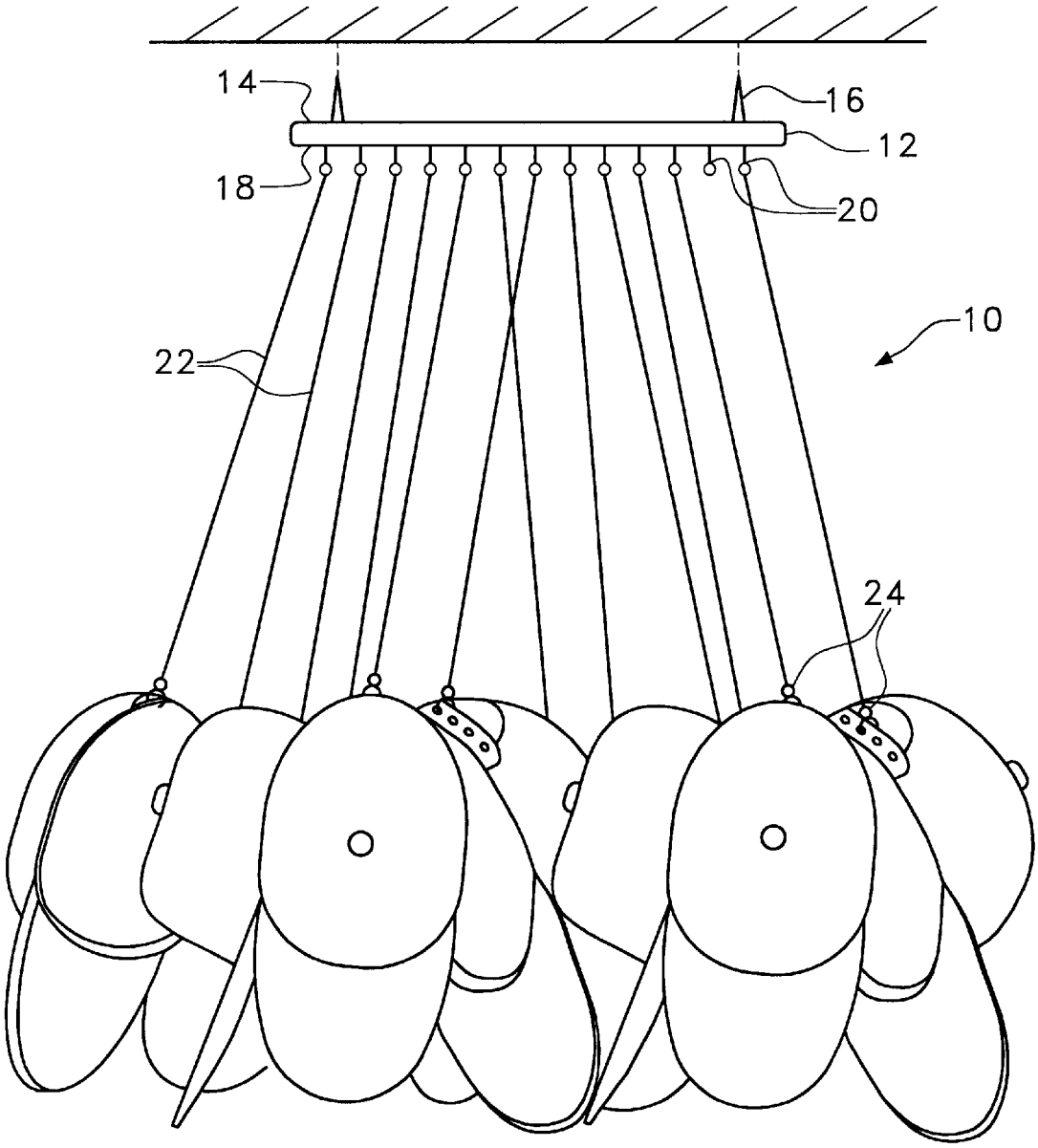
FIG. 1 is a front view of an exemplary embodiment of the present invention device shown in conjunction with numerous hats and a segment of a ceiling.

Referring to FIG. 1, an embodiment of a hat display assembly 10 is shown in accordance with the present invention. The hat display assembly 10 has a mounting plate 12. The mounting plate 12 has a flat top surface 14. Accordingly, the flat top surface 14 of the mounting plate 12 can be placed flush against a flat ceiling surface or a flat wall surface. The mounting plate 12 can be attached to a ceiling or a wall with adhesive. However, in the preferred embodiment, the mounting plate 12 is affixed to either a ceiling or a wall with mounting screws or similar mechanical fasteners 16, such as drywall anchor bolts or the like.

The bottom surface 18 of the mounting plate 12 is also flat. A plurality of mounting fixtures 20 extend outwardly from the bottom surface 18 of the mounting plate 12. The mounting fixtures 20 can be arranged in any pattern on the mounting plate 12. However, in the shown embodiment, the mounting fixtures 20 are arranged in parallel rows. Each mounting fixture 20 is a piece of hardware capable of engaging a wire, string or other flexible cord. In the shown embodiment, the mounting fixtures 20 are eye bolts. However, many other alternate embodiments can also be used.

A flexible cord 22 extends from each of the mounting fixtures 20. The flexible cord 22 can be a wire, string, chain or any other flexible element. Each flexible cord 22 has two ends. The first end of each flexible cord 22 is affixed to the mounting fixture 20 on the mounting plate 12. The second end of the flexible cord 22 terminates with an attachment mechanism 24. The length of the cord 22 between its two ends is preferably between one foot and four feet. However, lengths longer than four feet can also be used.

The attachment mechanism 24 at the far end of each of the flexible cords 22 can be any mechanism capable of engaging a hat. Accordingly, the attachment mechanisms 24 can be hooks, Velcro straps or the like. In the shown embodiment, the attachment mechanism 24 is a clip that can be selectively opened or closed with manual manipulation.

To utilize the assembly 10, the mounting plate 12 is attached to either the ceiling or the wall in a person's room. Hats are then attached to the attachment mechanisms 24 at the ends of each of the flexible cords 22. The hats then hang freely from the bottom of the flexible cords 22. As such, all the hats hanging on the assembly 10 are therefore readily visible. Additionally, since the hats hang freely from the flexible cords 22, the hats do not experience any significant deforming force that can crush or otherwise deform the hat.

Figure 2:
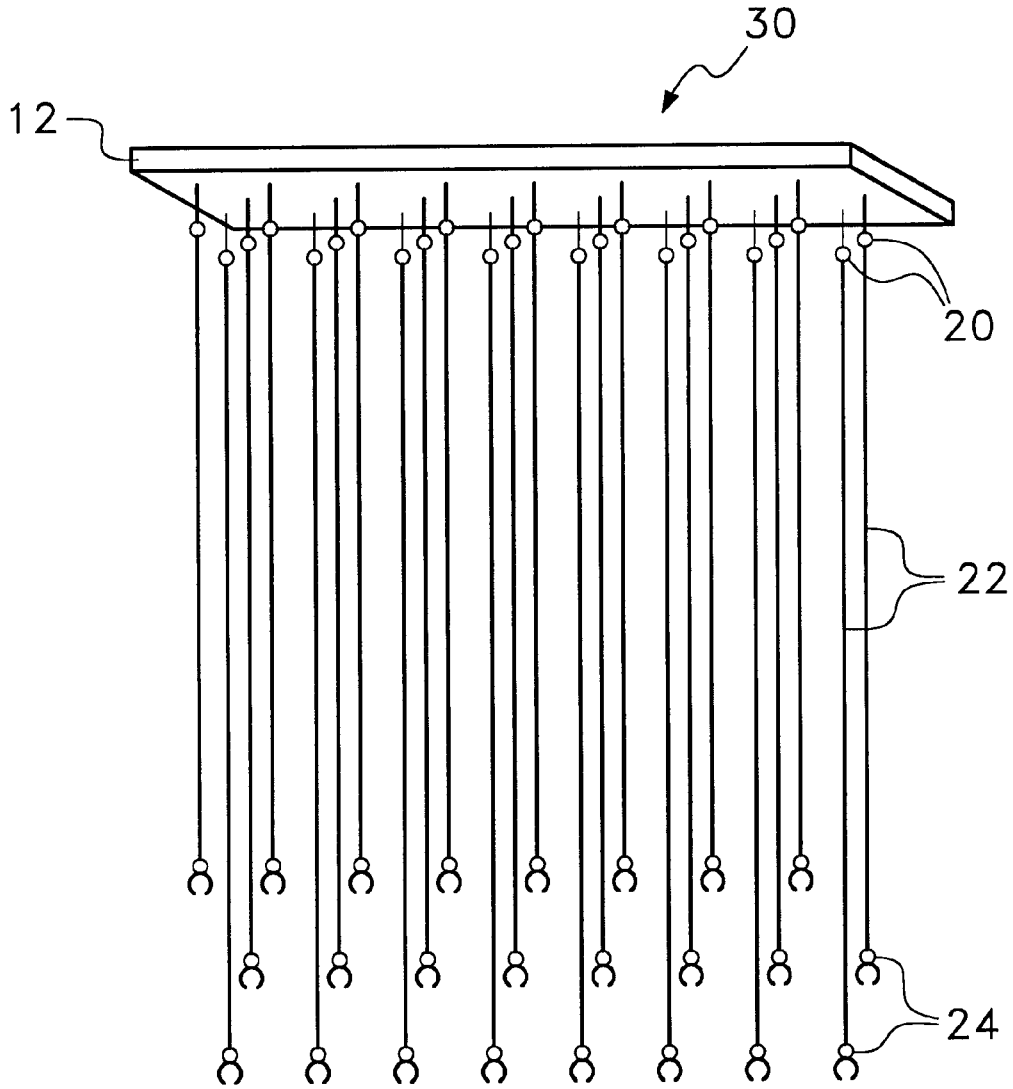
FIG. 2 is a perspective view of an alternate embodiment of the present invention device having flexible cords of different lengths.

Referring to FIG. 2, an alternate embodiment of the present invention assembly 30 is shown. Common reference numbers are used in reference parts that are the same as the original embodiment of FIG. 1. In the embodiment of FIG. 2, three rows of flexible cords 22 are shown extending from mounting fixtures 20 on a common mounting plate 12. Each of the rows of flexible cords 22 terminates at a different length. Accordingly, when hats are attached to the attachment mechanisms 24 at the end of each of the flexible cords 22, the hats will hang in a tiered configuration. The hats therefore will hang at three different levels, thereby enabling the hat to be better viewed.

In the embodiments of FIG. 1 and FIG. 2, the mounting plate 12 was a linear structure. Such a configuration is merely exemplary and it should be understood that the mounting plate can be circular, square or have any other configuration. It will also be understood that a person skilled in the art could make alternate embodiments of the present invention using functionally equivalent components that have not been specifically described. For example, the number and length of the various flexible cords can be altered as desired. All such obvious modifications are intended to be included in the scope of this disclosure as defined by the appended claims.

What is claimed is:

1. An apparatus for holding and displaying a plurality of hats, comprising:

a mounting plate having a flat top surface and a flat bottom surface;

a plurality of mounting fixtures coupled to said bottom surface of said mounting plate, said mounting fixtures being arranged in a plurality of parallel rows on said bottom surface of said mounting plate, wherein each of said parallel rows contains multiple mounting fixtures positioned thereon;

a plurality of flexible cords extending from said mounting fixtures, wherein said cords have first ends that are joined to said mounting fixtures and free hanging second ends; and clips coupled to said second end of each of said flexible cords, wherein each of said clips is capable of selectively engaging one of the plurality of hats.

2. The apparatus according to claim 1, wherein said flexible cords each have the same length.

3. The apparatus according to claim 1, wherein said flexible cords on each of said parallel rows has a common length that differs from said flexible cords on other of said parallel rows.

4. The apparatus according to claim 1, wherein each of said flexible cords has a length of between one foot and four feet.

5. The apparatus according to claim 1, further including a means for attaching said mounting plate to a ceiling.

6. A method of displaying a plurality of hats, comprising the steps of:

attaching a mounting plate to a ceiling;

suspending a plurality of flexible cords from said mounting plate, wherein said plurality of flexible cords are arranged in a plurality of parallel rows on said mounting plate; and connecting each of the hats to said plurality of flexible cords, wherein the hats hang suspended from said mounting plate by said plurality of flexible cords wherein said step of connecting each of the hats to said plurality of cords includes the substeps of connecting an attachment mechanism to each of said plurality of flexible cords and selectively connecting each of said attachment mechanisms to a hat.

7. The method according to claim 6, wherein said step of suspending a plurality of flexible cords from said mounting plate includes suspending a plurality of flexible cords of differing lengths on each of said parallel rows.

* * * * *